US011859480B2

(12) United States Patent
Kabrich et al.

(10) Patent No.: US 11,859,480 B2
(45) Date of Patent: Jan. 2, 2024

(54) CONTROLLING FLUID PRESSURES AT MULTIPLE WELL HEADS FOR CONTINUOUS PUMPING

(71) Applicant: Caterpillar Inc., Peoria, IL (US)

(72) Inventors: Todd R. Kabrich, Tomball, TX (US); Andy Publes, Katy, TX (US); Casey A. Otten, Spring, TX (US); Brandon J. Mabe, Houston, TX (US); Perry D. Converse, Lafayette, IN (US); Jason T. Herlehy, The Woodlands, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/692,887

(22) Filed: Mar. 11, 2022

(65) Prior Publication Data

US 2023/0287776 A1 Sep. 14, 2023

(51) Int. Cl.

| | |
|---|---|
| ***E21B 43/26*** | (2006.01) |
| ***F04B 23/04*** | (2006.01) |
| ***F04B 15/02*** | (2006.01) |
| ***F04B 49/03*** | (2006.01) |
| ***F04B 49/02*** | (2006.01) |

(Continued)

(52) U.S. Cl.

CPC ..... *E21B 43/2607* (2020.05); *E21B 43/26* (2013.01); *F04B 15/02* (2013.01); *F04B 23/04* (2013.01); *F04B 49/007* (2013.01); *F04B 49/022* (2013.01); *F04B 49/03* (2013.01); *F04B 49/065* (2013.01)

(58) Field of Classification Search

CPC ..... E21B 43/2607; E21B 43/26; F04B 15/02; F04B 23/04; F04B 49/007; F04B 49/022; F04B 49/03; F04B 49/065

See application file for complete search history.

(56) References Cited

U.S. PATENT DOCUMENTS

| | | | |
|---|---|---|---|
| 8,205,594 B2 | 6/2012 | Fore et al. | |
| 9,255,531 B2 | 2/2016 | Zhang et al. | |

(Continued)

FOREIGN PATENT DOCUMENTS

| | | | | |
|---|---|---|---|---|
| CN | 104302869 B | * | 1/2019 | ..... E21B 43/26 |
| WO | WO-2017136841 A1 | * | 8/2017 | ..... E21B 43/26 |

OTHER PUBLICATIONS

Unpublished U.S. Appl. No. 17/110,415, filed Dec. 3, 2020.
Unpublished GB Patent Application No. 2105452.3, filed Apr. 16, 2021.

*Primary Examiner* — James G Sayre

(57) ABSTRACT

A method may include monitoring, for two or more well heads of a hydraulic fracturing system, an operation or a state of one or more subsystems of the hydraulic fracturing system. The hydraulic fracturing system may include one or more fracturing rigs, one or more blending equipment, one or more power sources electrically connected to a first subset of the one or more fracturing rigs, or one or more fuel sources fluidly connected to a second subset of the one or more fracturing rigs, and one or more missile valves. The hydraulic fracturing system may further include one or more zipper valves, one or more well head valves, and multiple well heads. The method may further include controlling, based on an operation schedule for the hydraulic fracturing system and based on monitoring the operation or the state, fluid pressures at the two or more well heads for continuous pumping.

20 Claims, 5 Drawing Sheets

(51) Int. Cl.
*F04B 49/00* (2006.01)
*F04B 49/06* (2006.01)

(56) References Cited

U.S. PATENT DOCUMENTS 9,382,766 B2 7/2016 Flusche
9,683,503 B2 6/2017 Zhang et al.
9,889,915 B2 2/2018 Zhang et al.
9,896,982 B1 2/2018 Zhang et al.
10,415,348 B2 9/2019 Zhang et al.
10,458,352 B2 10/2019 Zhang et al.
10,563,649 B2 2/2020 Zhang et al.
10,734,814 B2 8/2020 Converse et al.
10,760,996 B2 9/2020 Converse et al.
10,890,061 B2 1/2021 Cai et al.
10,927,774 B2 2/2021 Cai et al.
11,585,200 B1 * 2/2023 Startz ..... E21B 34/02
2007/0125544 A1 * 6/2007 Robinson ..... E21B 43/26 166/305.1
2008/0190604 A1 8/2008 Hild et al.
2011/0030963 A1 * 2/2011 Demong ..... E21B 43/26 166/54.1
2013/0306322 A1 * 11/2013 Sanborn ..... E21B 43/2607 166/308.1
2014/0166268 A1 * 6/2014 Weightman ..... E21B 47/06 166/250.01
2014/0352968 A1 12/2014 Pitcher et al.
2017/0012439 A1 1/2017 Zhang et al.
2017/0130555 A1 * 5/2017 Kajaria ..... E21B 33/068
2017/0130712 A1 5/2017 Zhang et al.
2017/0198548 A1 * 7/2017 Dickinson ..... E21B 43/26
2020/0131877 A1 * 4/2020 Guidry ..... E21B 33/068
2021/0025267 A1 * 1/2021 Christie ..... E21B 43/26
2021/0164328 A1 6/2021 Redmond et al.
2022/0268141 A1 * 8/2022 Krupa ..... E21B 43/2607
2022/0290543 A1 * 9/2022 Bolen ..... E21B 43/2607

* cited by examiner

CONTROLLING FLUID PRESSURES AT MULTIPLE WELL HEADS FOR CONTINUOUS PUMPING

TECHNICAL FIELD

The present disclosure relates generally to multiple well heads, and more particularly, to controlling fluid pressures at the multiple well heads for continuous pumping.

BACKGROUND

Hydraulic fracturing is a means for extracting oil and gas from rock, typically to supplement a horizontal drilling operation. In particular, high-pressure fluid is used to fracture the rock, stimulating the flow of oil and gas through the rock to increase the volumes of oil or gas that can be recovered. A hydraulic fracturing rig used to inject high-pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at the same or different pressures to achieve a flow rate for the fluid (e.g., measured in barrels per minute). The fluid may be injected into multiple wells in the ground via multiple corresponding well heads. However, operation of the hydraulic fracturing system often involves the use of human operators to control switching of flow from one well head to another well head, and/or the like. These operators often have to be present on site and often have to be present in the field to perform such activities. This places the safety of the operator at risk, may not allow for sufficiently fast response time to changing well conditions, and/or the like.

U.S. Pat. No. 11,035,207, issued on Jan. 15, 2021 ("the '207 patent") describes that a pump down station is used when performing zipper hydraulic fracturing operations or during wireline pump down operations happening on one well, while main pumping operations are concurrently happening on a second well. However, the '207 patent does not disclose monitoring an operation or a state of one or more subsystems of a hydraulic fracturing system and controlling fluid pressures at two or more well heads for continuous pumping.

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to outlets of the one or more fracturing rigs, one or more zipper valves fluidly connected to outlets of the one or more missile valves, one or more well head valves fluidly connected to outlets of the one or more zipper valves, and multiple well heads fluidly connected to outlets of the one or more well head valves. The hydraulic fracturing system may further include a controller configured to monitor, for two or more well heads of the multiple well heads, an operation or a state of one or more subsystems of the hydraulic fracturing system. The controller may be further configured to control, based on an operation schedule for the hydraulic fracturing system and based on monitoring the operation or the state, fluid pressures at the two or more well heads for continuous pumping.

In another aspect, a method may include monitoring, for two or more well heads of a hydraulic fracturing system, an operation or a state of one or more subsystems of the hydraulic fracturing system. The hydraulic fracturing system may include one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, and one or more missile valves fluidly connected to outlets of the one or more fracturing rigs. The hydraulic fracturing system may further include one or more zipper valves fluidly connected to outlets of the one or more missile valves, one or more well head valves fluidly connected to outlets of the one or more zipper valves, and multiple well heads fluidly connected to outlets of the one or more well head valves. The method may further include controlling, based on an operation schedule for the hydraulic fracturing system and based on monitoring the operation or the state, fluid pressures at the two or more well heads for continuous pumping.

In yet another aspect, a controller for a hydraulic fracturing system may be configured to monitor, for two or more well heads of a hydraulic fracturing system, an operation or a state of one or more subsystems of the hydraulic fracturing system. The hydraulic fracturing system may include one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, and one or more missile valves fluidly connected to outlets of the one or more fracturing rigs. The hydraulic fracturing system may further include one or more zipper valves fluidly connected to outlets of the one or more missile valves, one or more well head valves fluidly connected to outlets of the one or more zipper valves, and multiple well heads fluidly connected to outlets of the one or more well head valves. The controller may be further configured to control, based on an operation schedule for the hydraulic fracturing system and based on monitoring the operation or the state, fluid pressures at the two or more well heads for continuous pumping.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
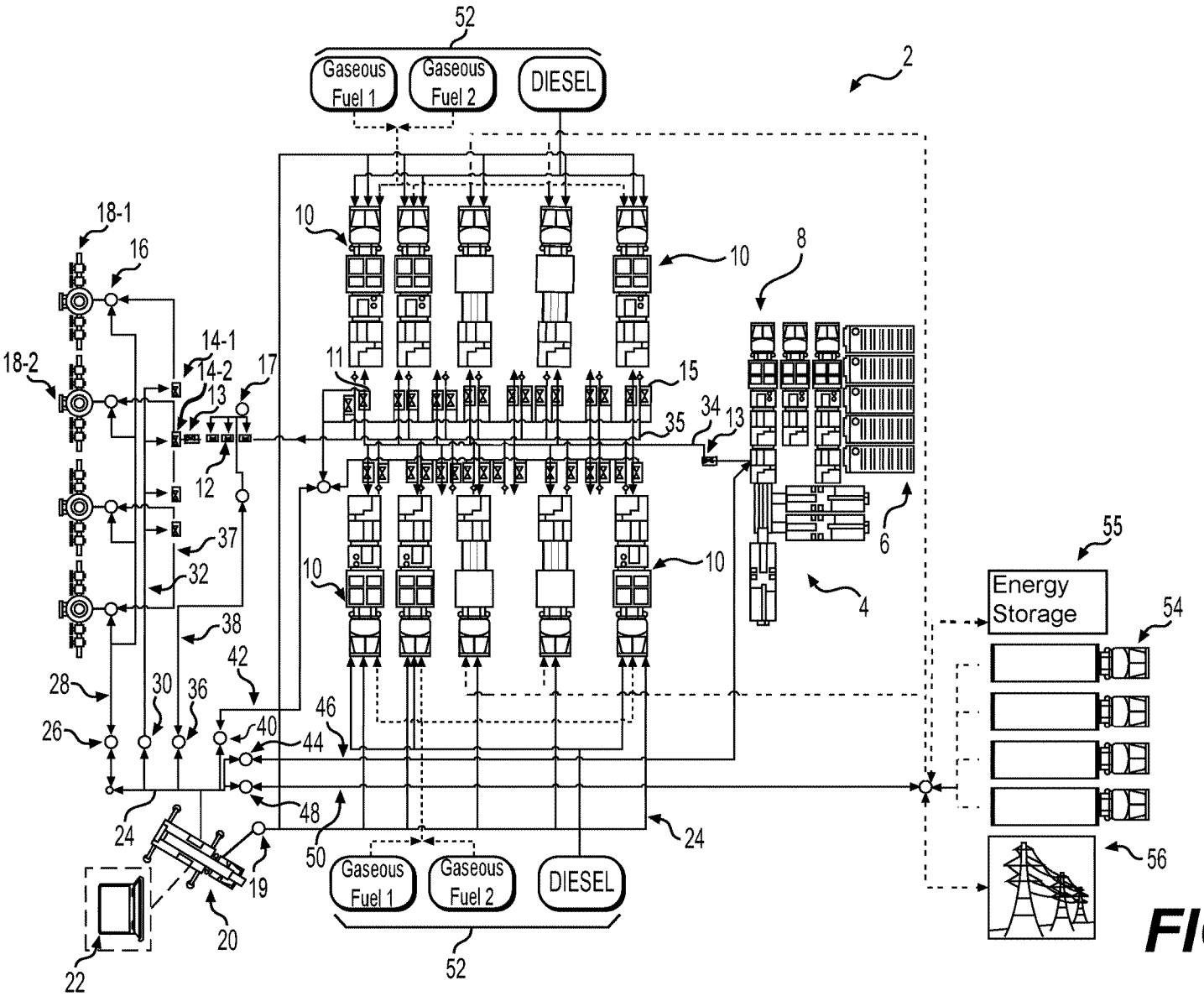
FIG. 1 is a schematic diagram of an exemplary hydraulic fracturing system including a plurality of hydraulic fracturing rigs, according to aspects of the disclosure.

FIG. 1 illustrates an exemplary hydraulic fracturing system 2 according to aspects of the disclosure. In particular, FIG. 1 depicts an exemplary site layout according to a well stimulation stage (e.g., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at pressure through one or more low pressure fluid lines 34 to one or more fracturing rigs 10 (FIG. 1 illustrates ten fracturing rigs 10 and two types of fracturing rigs—4 electric fracturing rigs 10 and 6 hydraulic fracturing rigs 10). One or more types of fracturing rigs 10 may be used in connection with certain embodiments, such as mechanical fracturing rigs 10, hydraulic fracturing rigs 10, electric fracturing rigs 10, and/or the like. The one or more fracturing rigs 10 may pump the fracturing fluid at high pressure to a well head 18 (FIG. 1 illustrates four well heads 18) through one or more high-pressure fluid lines 35. The one or more fracturing rigs 10 may be controlled by one or more rig controllers 19 (e.g., a rig controller 19 may receive, process, and/or provide to the fracturing rigs 10 a desired flow or pressure for a job).

A bleed off tank (not shown in FIG. 1) may be provided to receive bleed off liquid or gas from the fluid lines 34 and/or 35 (e.g., via one or more automatic pressure relief valves 13). In addition, nitrogen, which may be beneficial to the hydraulic fracturing process for a variety of reasons, may be stored in tanks, with a pumping system (not shown in FIG. 1) used to supply the nitrogen from the tanks to the fluid lines 35 or a well head 18.

In order to control flow of fluid, the hydraulic fracturing system 2 may include various types of valves. For example, the hydraulic fracturing system 2 may include one or more low pressure missile valves 11 upstream from the inlet of hydraulic fracturing pumps of the fracturing rigs 10 (e.g., an inlet of the low pressure missile valves 11 may be fluidly connected to fluid lines 34 and outlets of the low pressure missile valves 11 may be fluidly connected to the inlets of the hydraulic fracturing pumps). For example, the low pressure missile valves 11 may control fluid flow from fluid lines 34 to the hydraulic fracturing pumps of the fracturing rigs 10. Additionally, or alternatively, the hydraulic fracturing system 2 may include one or more check valves 15 (e.g., actuated or one-way check valves 15) that may be upstream from a fracturing tree being served by the fracturing rigs 10 (e.g., outlets of the pumps of the fracturing rigs 10 may be fluidly connected to inlets of the check valves 15 and outlets of the check valves 15 may be fluidly connected to inlet(s) of the fracturing tree). Additionally, or alternatively, the hydraulic fracturing system 2 may include one or more large bore valves 12 (e.g., on/off ball valves) of a grease system (FIG. 1 illustrates three large bore valves 12). "Large bore" may refer to a line where flow is consolidated into one line and large bore valves 12 may shut the well off from missile lines. The hydraulic fracturing system 2 may include a system 17 that may gather data related to the hydraulic fracturing system 2 and may provide the data to the controller 58 for event correction and/or maintenance monitoring. For example, the controller 58 may track maintenance based on the data from the system 17 and may send a message to an operator or to the system 17 to grease the large bore valves 12, e.g., after a certain number of cycles of opening/closing the large bore valves 12. One or more other similar systems may be included in the hydraulic fracturing system 2 for monitoring operations of certain elements of the hydraulic fracturing system 2 and/or for taking corrective or maintenance-related actions. The large bore valves 12 may be downstream of outlets of the check valves 15 (e.g., inlets of the large bore valves 12 may be fluidly connected to outlets of the check valves 15). Additionally, or alternatively, the hydraulic fracturing system 2 may include one or more automatic pressure relief valves 13 (FIG. 1 illustrates one automatic pressure relief valve 13). For example, the automatic pressure relief valves 13 may be downstream of the one or more large bore valves 12 (e.g., inlets of the one or more automatic pressure relief valves 13 may be fluidly connected to outlets of the one or more large bore valves 12). The automatic pressure relief valves 13 may be controlled and/or triggered automatically to release fluid pressure from fluid lines 35.

Additionally, or alternatively, the hydraulic fracturing system 2 may include one or more zipper valves 14 (FIG. 1 illustrates four zipper valves 14) downstream of the automatic pressure relief valves 13 (e.g., outlets of the automatic pressure relief valves 13 may be fluidly connected to inlets of the zipper valves 14). The zipper valves 14 may control fluid flow from fluid lines 35 to individual well heads 18 via zipper piping 37 (e.g., zipper piping may fluidly connect large bore valves 12 to the well heads 18). The hydraulic fracturing system 2 may further include one or more well head valves 16 (FIG. 1 illustrates four well head valves 16) downstream of the outlet of the zipper valves 14 (e.g., outlets of the zipper valves 14 may be fluidly connected to inlets of the well head valves 16). The well head valves 16 may provide further fluid control to the well heads 18 from the fluid lines 35.

The hydraulic fracturing process performed at the site, using the hydraulic fracturing system 2 of the present disclosure, and the equipment used in the process, may be managed and/or monitored from a single location, such as a data monitoring system 20, located at the site or at additional or alternative locations. According to an example, the data monitoring system 20 may be supported on a van, truck or may be otherwise mobile. As will be described below, the data monitoring system 20 may include a user device 22 for displaying or inputting data for monitoring performance and/or optimizing operation of the hydraulic fracturing system 2 and/or the fracturing rigs 10. According to one embodiment, the data gathered by the data monitoring system 20 may be sent off-board or off-site for monitoring, recording, or reporting of performance of the hydraulic fracturing system 2 (or elements of the hydraulic fracturing system 2) and/or for performing calculations related to the hydraulic fracturing system 2.

The data monitoring system 20 (or a controller of the data monitoring system 20) may be communicatively connected to one or more controllers of the hydraulic fracturing system 2 that control subsystems of the hydraulic fracturing system 2. For example, the data monitoring system 20 may be connected to the controllers via wired or wireless communication channels 24 The controllers may include a well head valve controller 26 connected to the one or more well head valves 16 and/or well heads 18 via a wired or wireless communication channel 28. The well head valve controller 26 may be configured to actuate the one or more well head valves 16 and/or one or more mechanical components of the well heads 18. Actuation of a valve or a well head 18 may include actuating one or more mechanical components to an open state, to a closed state, or to a partially closed or partially open state. Actuation, as described herein, may be performed by an associated actuator that may be integrated with the component to be actuated or may be a separate component (e.g., electric actuation of a valve may be performed through the use of an actuator integrated with a valve whereas hydraulic actuation may be performed through the use of an actuator located remote to the valve). Additionally, or alternatively, the controllers may include a zipper valve controller 30 connected to the one or more zipper valves 14 via a wired or wireless communication channel 32. The zipper valve controller 30 may be configured to actuate the one or more zipper valves 14.

The controllers may, additionally, or alternatively, include a large bore valve controller 36 connected to the one or more large bore valves 12 via a wired or wireless communication channel 38. The large bore valve controller 36 may be configured to actuate the one or more large bore valves 12. The controllers may further include a valve controller 40 connected to the one or more low pressure missile valves 11 and/or the one or more check valves 15 via a wired or wireless communication channel 42. The valve controller 40 may be configured to actuate the one or more low pressure missile valves 11 and/or the one or more check valves 15.

Additionally, or alternatively, the controllers may include a blender controller 44 connected to the blending equipment 8 via a wired or wireless communication channel 46. The blender controller 44 may be configured to control operations of the blending equipment 8 (e.g., to control preparation of the fracturing fluid). The controllers may further include a power source controller 48 connected to various power sources (e.g., generators 54, such as gaseous or blended generators 54, energy storages 55, such as batteries or fuel cells, and/or a utility power grid 56) included in the hydraulic fracturing system 2 via a wired or wireless communication channel 50. The generators 54 illustrated in FIG. 1 may be mobile generators 54 and may include turbine-based generators 54 or engine-based generators 54. Other power sources may include renewable energy sources, such as solar cells, wind turbines, and/or the like from a microgrid. The power source controller 48 may be configured to control one or more power sources and/or to control the provisioning of power from the power sources. For example, the power source controller 48 may power on or power off a generator 54 to meet power expectations, may switch one or more equipment of the hydraulic fracturing system 2 from consuming power from the utility power grid 56 to consuming power from one or more generators 54 and/or energy storages 55 (or vice versa), and/or the like.

Fuel sources 52 may provide fuel (e.g., gas, compressed natural gas (CNG), hydrogen (H2), propane, field gas, diesel, etc.) to the mechanical fracturing rigs 10. The provisioning of fuel to the fracturing rigs 10 may be controlled by a controller associated with the data monitoring system 20 and/or one or more other controllers associated with the fuel sources.

Generators 54 may provide energy to fracturing rigs 10. The provisioning of energy to the fracturing rigs 10 may be controlled by a controller associated with the data monitoring system 20 and/or one or more other controllers associated with the fuel sources.

Elements of the hydraulic fracturing system 2 may be configured to operate in one or more operational modes. The one or more operational modes may include a manual mode where, for example, an operator programs desired operational parameters for elements of the hydraulic fracturing system 2 via the user device 22 and the operator ramps the hydraulic fracturing system 2 to the desired operational parameters via the user device 22. In addition, in the manual mode, the operator may, via the user device 22, approve or decline optimized operational parameters determined by the data monitoring system 20 according to certain embodiments described herein. Additionally, or alternatively, the one or more operational modes may include a semi-closed mode where, for example, the operator ramps the hydraulic fracturing system 2 to desired operational parameters via the user device 22 and a controller 58 may optimize the operation of the hydraulic fracturing system 2 based on operator input (e.g., fuel optimization, emissions optimization, total cost of ownership optimization, and/or the like).

Additionally, or alternatively, the one or more operational modes may include a closed mode where, for example, the operator programs the desired operational parameters via the user device 22, and one or more controllers (e.g., controller 58 and/or controllers 64) ramp the operation of the hydraulic fracturing system 2 to the desired and/or optimized operational parameters. Additionally, or alternatively, the one or more operational modes may include an autonomous mode where, for example, the operator is remote to the data monitoring system 20 and/or a hydraulic fracturing site, and one or more controllers (e.g., controller 58 and/or controllers 64) may monitor and control the operational parameters of the hydraulic fracturing system 2 automatically (e.g., automatically ramp operation of the hydraulic fracturing system 2 to desired operational parameters, determine and implement optimized operational parameters, etc.). The autonomous mode may additionally include operating in the closed mode with sub-controllers for valves of the hydraulic fracturing system 2. Additionally, or alternatively, the one or more operational modes may include a multi-site mode where, for example, the operator can monitor and/or control operations of multiple hydraulic fracturing systems 2 at different sites. In some embodiments, the multi-site mode may include operating in the autonomous mode across multiple fracturing sites.

Figure 2:
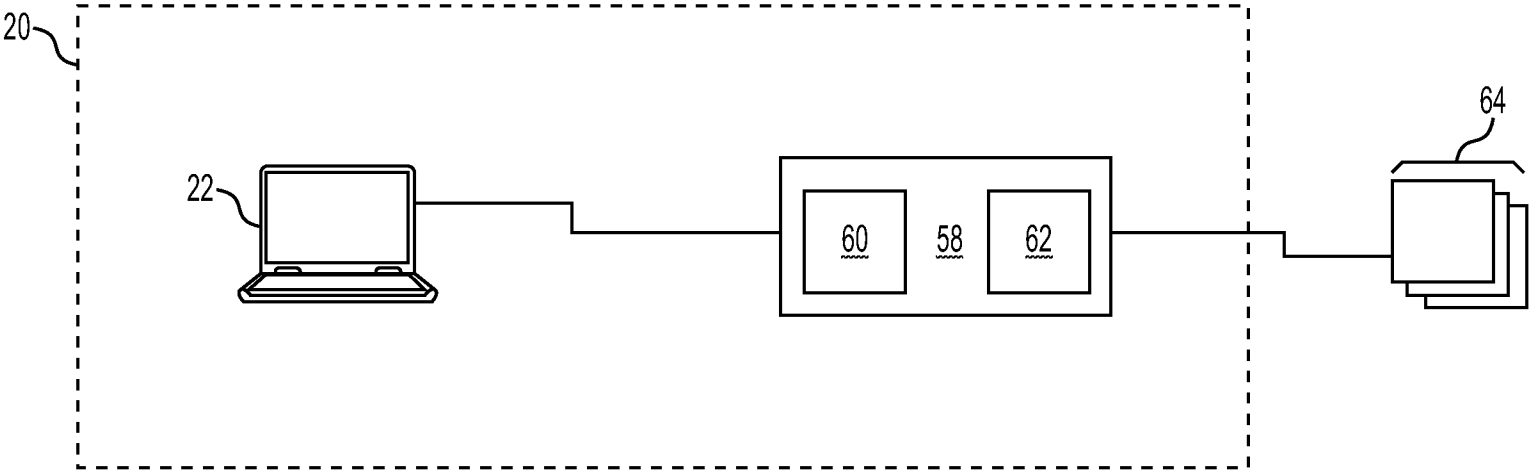
FIG. 2 is a schematic diagram of a data monitoring system and associated controllers of the hydraulic fracturing system of FIG. 1, according to aspects of the disclosure.

Referring to FIG. 2, the data monitoring system 20 may include the user device 22 and a controller 58. The controller 58 may be provided, and may be part of, or may communicate with, the data monitoring system 20. The controller 58 may reside in whole or in part at the data monitoring system 20, or elsewhere relative to the hydraulic fracturing system 2. The user device 22 and the controller 58 may be communicatively connected to each other via one or more wired or wireless connections for exchanging data, instructions, etc. Further, the controller 58 may be configured to communicate with one or more controllers 64 via wired or wireless communication channels. For example, the controller 58 may monitor and control, via the controllers 64, various subsystems of the hydraulic fracturing system 2. The controllers 64 may include the rig controller 19, the well head valve controller 26, the zipper valve controller 30, the large bore valve controller 36, the valve controller 40, the blender controller 44, and/or the power source controller 48.

The controllers 64 may be configured to communicate with one or more sensors (not shown in FIG. 2) located on elements of the hydraulic fracturing system 2. For example, the valve controller 40 may be configured to communicate with one or more sensors located at one or more valves, at components (e.g., an engine, a pump, etc.) of a fracturing rig 10, etc. A sensor may be configured to detect or measure one or more physical properties related to operation and/or performance of the various elements of the hydraulic fracturing system 2. For example, a sensor may be configured to provide a sensor signal indicative of a state of a valve (e.g., open, closed, a percentage open, or a percentage closed) to one or more of the controllers 64, which may be configured to provide the sensor signal to the controller 58.

The controller 58 and/or the controllers 64 may include a processor and a memory (not illustrated in FIG. 2). The processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor may possess its own local memory, which also may store program modules, program data, and/or one or more operating systems. The processor may include one or more cores.

The memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 22, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the controller 58 and/or the controllers 64.

The memory may be capable of storing various computer readable instructions for performing certain operations described herein (e.g., operations of the controller 58 and/or the controllers 64). The instructions, when executed by the processor and/or the hardware logic component, may cause certain operations described herein to be performed.

The controller 58 may store and/or execute an optimization program 60 to optimize operations of the hydraulic fracturing system 2 (e.g., based on data stored in the memory or as otherwise provided to the controller 58, such as via the user device 22, gathered by the controllers 64, or from a database). The controller 58 may store and/or execute a control logic program 62 (as described in more detail below with respect to FIG. 4). Data used by the controller 58 may include site configuration-related information, scheduling-related information, cost-related information, emissions-related information, operation-related or state-related information, system operating parameters, and/or the like. However, various other additional or alternative data may be used.

Figure 3:
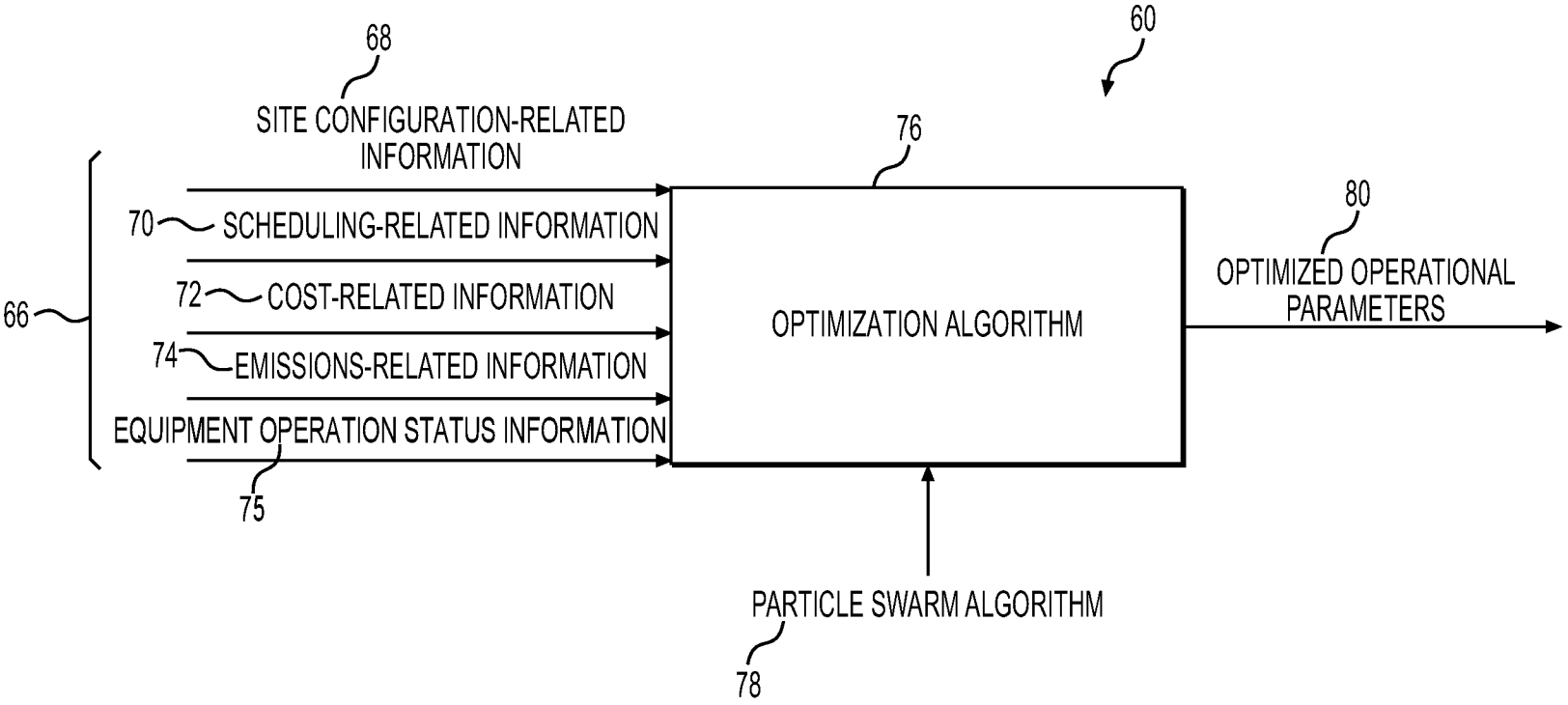
FIG. 3 is a diagram illustrating an exemplary optimization program, according to aspects of the disclosure.

FIG. 3 is a diagram illustrating an exemplary optimization program 60, according to aspects of the disclosure. As illustrated in FIG. 3, the optimization program 60 may receive input data 66 and may use the input data 66 with an optimization algorithm 76. For example, the optimization program 60 may receive the input data 66 from the user device 22 (e.g., a user may input the input data 66 via the user device 22), from a server device, from a database, from memory of various equipment or components thereof of the hydraulic fracturing system 2, and/or the like. The optimization program 60 may receive the input data 66 as a stream of data during operation of the hydraulic fracturing system 2, prior to starting operations of the hydraulic fracturing system 2, and/or the like. The input data 66 may be predetermined and provided to the optimization program 60 (e.g., may be based on experimental or factory measurements of equipment), may be generated by the controller 58 (e.g., the controller 58 may broadcast a ping communication at a site in order to receive response pings from equipment at the site to determine which equipment is present, the controller 58 may measure, from sensor signals, the input data 66, etc.), and/or the like.

The input data 66 may include site configuration-related information 68. For example, the site configuration-related information 68 may include numbers and/or types of elements of the hydraulic fracturing system 2, powertrain types of the fracturing rigs 10 (e.g., mechanical or electric powertrain configurations), sub-types of mechanical powertrains (e.g., fuel types or levels of emission certified combustion engines), sub-types of electric powertrains (e.g., turbine generators, reciprocating engine generators, hydrogen fuel cells, energy storage systems, such as batteries, or direct-to-grid), possible operating modes of the elements of the hydraulic fracturing system 2 (e.g., an operator-based mode, a semi-closed mode, a closed mode, an autonomous mode, etc.), a maximum allowed pressure or flow rate of a fracturing rig 10 at the site, quantities and/or types of other equipment located at the site, ages, makes, models, and/or configurations of the equipment at the site, and/or the like. Additionally, or alternatively, the input data 66 may include scheduling-related information 70. For example, the scheduling-related information 70 may include times, dates, durations, locations, etc. for certain operations of the hydraulic fracturing system 2, such as scheduled times and dates for certain pump pressures, scheduled openings or closings of valves, etc.

Additionally, or alternatively, the input data 66 may include cost-related information 72. For example, the cost-related information 72 may include a cost of fuel or power for the hydraulic fracturing system 2, a total cost of ownership of elements of the hydraulic fracturing system 2 (e.g., including maintenance costs, costs of fracturing fluid, or personnel costs), a cost of emissions (e.g., regulatory costs applied to emissions or costs related to reducing emissions, such as diesel exhaust fluid (DEF) costs), and/or the like. Additionally, or alternatively, the input data 66 may include emissions-related information 74. For example, the emissions-related information 74 may include an amount of emissions from elements of the hydraulic fracturing system 2 (e.g., at different operating levels of the equipment), and/or the like. Additionally, or alternatively, the input data 66 may include equipment operation status information 75. For example, the equipment operation status may include an operational mode of equipment of the hydraulic fracturing system 2, such as for verification of requests to change the operational status of the equipment. The input data 66 may include various other types of data depending on the objective to be optimized by the optimization algorithm 76. For example, the input data 66 may include transmission gear life predictions, pump cavitation predictions, pump life predictions, engine life predictions, and/or the like.

As described in more detail herein, the optimization algorithm 76 may process the input data 66 after receiving the input data 66. For example, the optimization algorithm 76 may process the input data 66 using a particle swarm algorithm 78. The optimization algorithm 76 may then output optimized operational parameters 80 for the hydraulic fracturing system 2 to the user device 22 for viewing or modification, to the controller 58 and/or the controllers 64 to control operations of the hydraulic fracturing system 2, and/or to a database for storage. Optimized operational parameters 80 may include, for example, values for engine power output, gear ratio, engine revolutions, throttle control, pump pressure, flow rate, or transmission speed optimized for emissions output, fuel consumption, lowest cost of operation, and/or the like.

Figure 4:
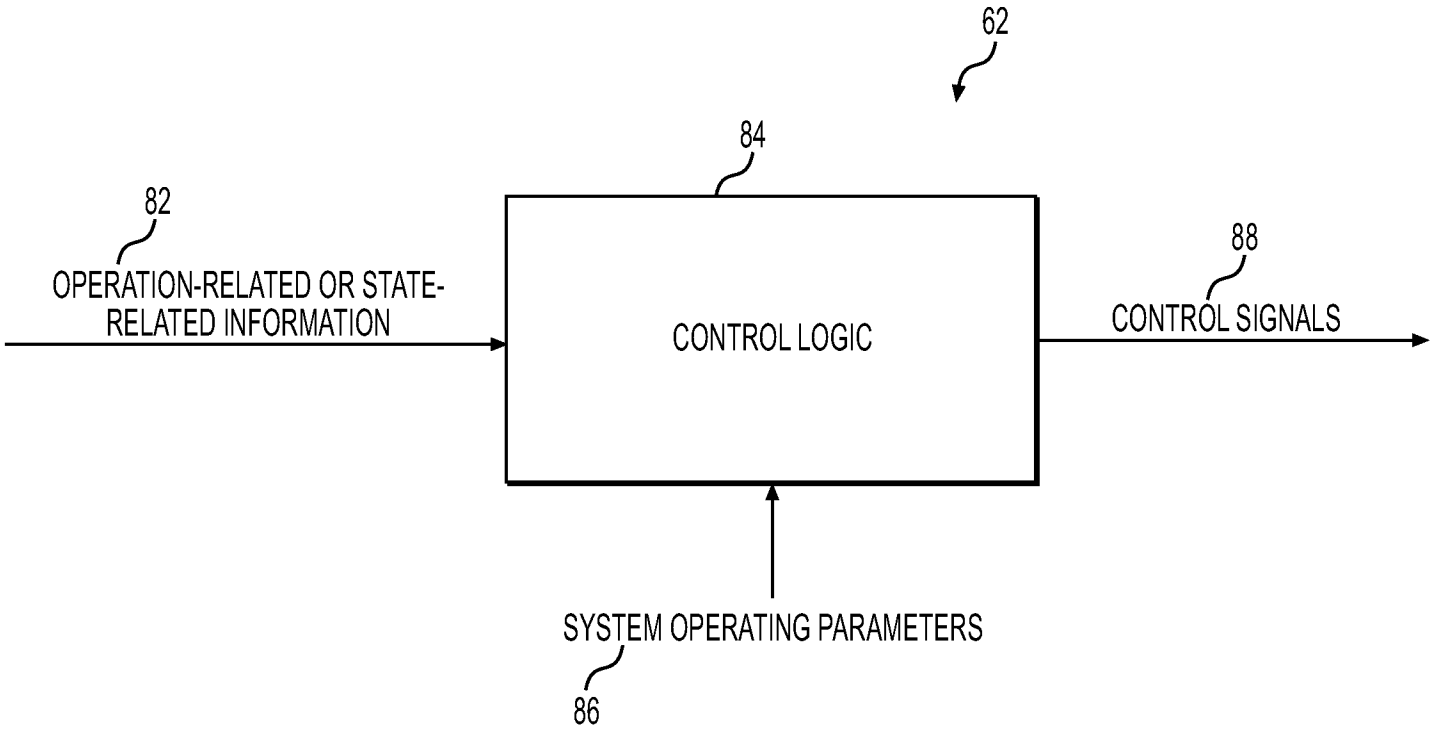
FIG. 4 is a diagram illustrating an exemplary control logic program, according to aspects of the disclosure.

FIG. 4 is a diagram illustrating an exemplary control logic program 62, according to aspects of the disclosure. As illustrated in FIG. 4, the control logic program 62 may receive operation-related or state-related information 82 and may provide this information to control logic 84. The operation-related or state-related information may include, for example, an operating pressure at a well head 18 or other elements of the hydraulic fracturing system 2, an operating transmission gear or speed of the mechanical fracturing rigs 10 or power consumption of electric fracturing rigs 10, a fuel or power consumption rate or elements of the hydraulic fracturing system 2, a mixture of the fracturing fluid, whether certain types of elements or certain instances of certain types of elements are in operation, whether valves are opened or closed (or a degree to which they are opened or closed), and/or the like.

The control logic program 62 may process the operation-related or state-related information 82 using control logic 84. For example, the control logic 84 may be based on system operating parameters 86, which may include operating limits, operating expectations, operating baselines, and/or the like for the hydraulic fracturing system 2. The control logic 84 may then output control signals 88 based on the processing. For example, the control signals 88 may modify the operation of the hydraulic fracturing system 2 to avoid exceeding operating limits, to ramp operation of equipment to operating expectations, to ramp operation of equipment to exceed operating baselines, and/or the like.

INDUSTRIAL APPLICABILITY

The aspects of the controller 58 of the present disclosure and, in particular, the methods executed by the controller 58 may be used to assist in monitoring an operation or a state of one or more subsystems of a hydraulic fracturing system 2 and control fluid pressures at multiple well heads 18 for continuous pumping. Thus, certain aspects described herein may provide various advantages to the operation of the hydraulic fracturing system 2, such as helping to ensure that pumping continues at a well during switching from one well head 18 to another well head 18, which may help to prevent certain events, such as well collapse, from occurring during such a switch. In addition, the controller 58 may control the well heads 18 according to an operation schedule, which may improve safety at a fracturing site by reducing or eliminating a need for an operator to be present at the well heads 18. Similarly, by automatically controlling the well head 18 according to an operation schedule, hydraulic fracturing operations can be more closely aligned to the intended schedule, which may reduce latency between stages of hydraulic fracturing operations, improve safety at a hydraulic fracturing site by reducing or eliminating implementation of incorrect fracturing operations due to deviations from the operation schedule, and/or the like. In addition, the controller 58 may monitor and control operations of multiple different well heads 18 at the same time (based on real-time or near real-time information), in a way very difficult or not possible through operator-based operation of the hydraulic fracturing system 2. This may increase an efficiency of fracturing operation of the hydraulic fracturing system 2.

Figure 5:
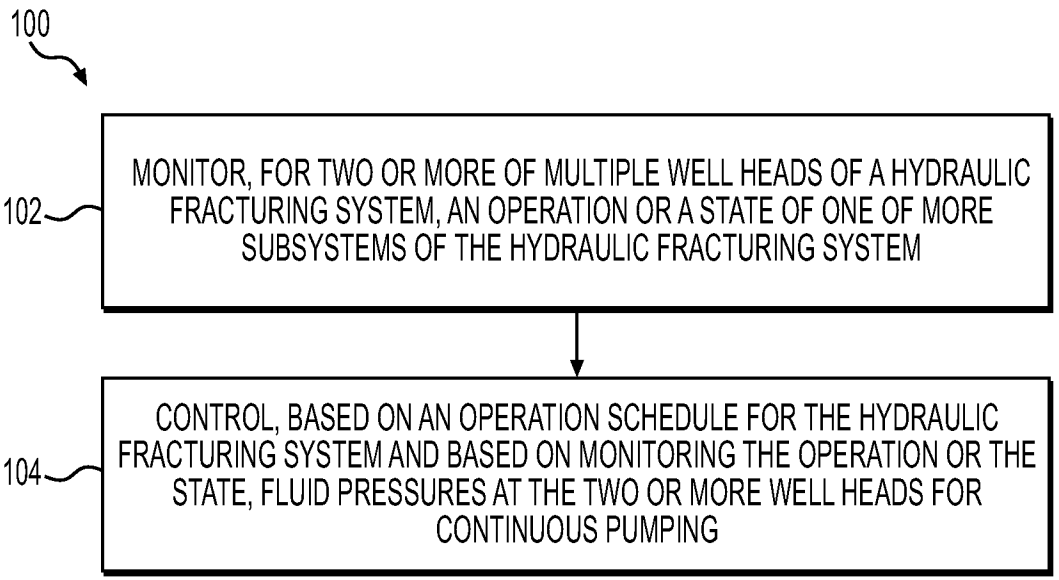
FIG. 5 illustrates a flowchart depicting an exemplary method for monitoring one or more subsystems of a hydraulic fracturing system and controlling fluid pressures at multiple well heads for continuous pumping, according to aspects of the disclosure.

FIG. 5 illustrates a flowchart depicting an exemplary method 100 for monitoring and controlling fluid pressures of multiple well heads 18, according to aspects of the disclosure. The method 100 illustrated in FIG. 5 may be implemented by the controller 58. The steps of the method 100 described herein may be embodied as machine readable and executable software instructions, software code, or executable computer programs stored in a memory and executed by a processor of the controller 58. The software instructions may be further embodied in one or more routines, subroutines, or modules and may utilize various auxiliary libraries and input/output functions to communicate with other equipment. The method 100 illustrated in FIG. 5 may also be associated with an operator interface (e.g., a human-machine interface, such as a graphical user interface (GUI)) through which an operator of the hydraulic fracturing system 2 may configure the optimization algorithm 76 and/or the control logic 84, may select the input data 66 or the operation-related or state-related information 82, may set objectives for the optimization algorithm 76 (e.g., objectives for the particle swarm algorithm 78), and/or the like. Therefore, the method 100 may be implemented by the controller 58 to provide for continuous pumping. For example, the controller 58 may open the well head 18-2 and the zipper valves 14-2, may start pumping to the well head 18-2, and may then close the well-head 18-1 and the zipper valves 14-1 so that pumping is switched automatically from the well head 18-1 to the well head 18-2 without stopping the pumping. The controller 58 may determine a manner in which to control elements of the hydraulic fracturing system 2 for continuous pumping during a well head switch based on configurations (and limits) of the valves and/or well heads. This may prevent damage that might otherwise occur by continuing to pump while switching from one well head to another. Additionally, or alternatively, the controller 58 may close and open the well heads 18-1 and 18-2 automatically according to a schedule.

At step 102, the controller 58 may monitor, for two or more of multiple well heads 18 of a hydraulic fracturing system 2, an operation or a state of one or more subsystems of the hydraulic fracturing system 2. For example, the controller 58 may receive the operation-related or state-related information 82 as a stream of data, according to a schedule, etc. Additionally, or alternatively, the controller 58 may receive the operation-related or state-related information 82 from a sensor, from one or more of the controllers 64, as input via the user device 22, from a server device, and/or the like. In connection with the monitoring at step 102, the controller 58 may additionally receive a configuration of the system operating parameters 86 via the user device 22, from memory, from a server device, from a remote control center, and/or the like.

A subsystem may include, for a certain well head 18, particular equipment of the hydraulic fracturing system 2 associated with pumping fracturing fluid to the well head 18. For example, the one or more subsystems may include the blending equipment 8, certain fracturing rigs 10 (e.g., mechanical and/or electric fracturing rigs 10), components of the fracturing rigs 10 (e.g., engines, pumps, transmissions, etc. for mechanical fracturing rigs 10 or variable frequency drives (VFDs) and electric motors for electric fracturing rigs 10), certain low pressure missile valves 11, certain large bore valves 12, certain zipper valves 14 and/or zipper piping 37 and zipper valve 14 sets, the check valves 15, certain well head valves 16, the well head valve controller 26, the zipper valve controller 30, the large bore valve controller 36, the valve controller 40, the power source controller 48, certain fuel sources 52, the power sources, and/or the like. For example, a well head 18 may have dedicated valves, fracturing rigs 10, and/or the like, and these may be the subsystems monitored for the well head 18 rather than monitoring all of the valves, fracturing rigs 10, etc. of the hydraulic fracturing system 2. This may conserve computing resources of the controller 58 by reducing an amount of information that the controller 58 has to process.

In some embodiments, the operation or the state of the one or more subsystems may be monitored for multiple well heads 18 at the same time. For example, FIG. 1 illustrates the hydraulic fracturing system 2 as including four well heads 18. In this example, the controller 58 may monitor the operation or the state of a first fracturing rig 10, a first missile valve 11, a first large bore valve 12, a first zipper valve 14, and a first well head valve 16 for a first well head 18, may monitor the operation or the state of a second fracturing rig 10, a second missile valve 11, a second large bore valve 12, a second zipper valve 14, and a second well head valve 16 for a second well head 18, and so forth.

At step 104, the controller 58 may control, based on an operation schedule for the hydraulic fracturing system and based on monitoring the operation or the state, fluid pressures at the two or more well heads for continuous pumping. For example, the controlling may include starting pumping at a first well head 18 then starting simultaneous pumping at a second well head 18. After the pumping is started at the second well head 18, the pumping is stopped at the first well head 18. This usage of simultaneous pumping at multiple well heads 18 may prevent flow from stopping to a well while fluid flow is switched from the first well head 18 to the second well head 18. Starting or stopping pumping at a well head 18 may include starting or stopping the one or more subsystems associated with the well head 18. For example, blending equipment 8 and a fracturing rig 10 may be started or stopped, various valves may be opened to start pumping to the well head 18 or closed to stop the pumping, and/or the like.

In some embodiments, the controller 58 may determine to switch the flow between well heads 18 based on the monitoring. For example, the controller 58 may control the well heads 18 automatically based on determining that pumping through a first well head 18 is not meeting operating expectations or is exceeding operating limits (e.g., pressure limits, time limits, etc.), where the failure to meet operating expectations or the exceeding of operating limits may indicate that the pumping is to be switched from the first well head 18 to the second well head 18. In performing these determinations, the controller 58 may process the information received at step 102 using the control logic 84 to determine whether operational limits have been exceeded, whether the equipment of the hydraulic fracturing system 2 are operating at least at minimum operating baselines or within expected ranges, etc. For example, the controller 58 may perform a comparison of the operation-related or state-related information 82 to system operating parameters 86 and may determine that the fluid pressure at the well head 18 is not meeting expectations or is beyond operating limits. The controller 58 may then determine to switch from the first well head 18 to the second well head 18 based on a result of processing using the control logic 84.

The controller 58 may then provide control signals 88 to the controllers 64 and/or directly to equipment of the hydraulic fracturing system 2 to implement the continuous pumping. For example, the controller 58 may provide control signals 88 to start blending equipment 8 and/or fracturing rigs 10, to open valves at a second well head 18, to close valves at a first well head 18, to stop blending equipment 8 and/or fracturing rigs 10, and/or the like. Additionally, or alternatively, the controller 58 may output operational parameters (or instructions for modifying operational parameters) to the controllers 64, and the controllers 64 may generate the control signals 88. In certain embodiments, the operational parameters output from the controller 58 may include optimized operational parameters 80 (e.g., the controller 58 may perform the optimization algorithm 76 prior to outputting the control signals 88, as described in more detail elsewhere herein).

The operation schedule may include days, times, durations, etc. for operation of the well head 18 and corresponding fluid pressures for the various different days, times, durations, etc. (e.g., for a planned well completion). When controlling the fluid pressure, the controller 58 may process the operation schedule to determine whether the fluid pressure needs to be modified, to determine optimized operational parameters for achieving a fluid pressure (or preventing a pressure limit from being exceeded), and/or the like. For example, the controller 58 may process the operation schedule to determine whether the fluid pressure at the well head 18 matches a scheduled fluid pressure, whether to increase or decrease the fluid pressure based on an amount of time that the fracturing operations have been performed at a site, and/or the like. This may facilitate continuous operation of hydraulic fracturing operations, pre-scheduling of control signals 88, and/or the like in a manner very difficult or not possible with operator-controlled hydraulic fracturing operations, which may increase an efficiency of hydraulic fracturing operations of the hydraulic fracturing system 2.

In connection with the steps 102 and 104, the controller 58 may monitor information including an open or closed state of various valves of the hydraulic fracturing system 2, and may control the valves to start pumping at one well head 18 while pumping is occurring at another well head 18. For example, the controller 58 may generate control signals 88 to actuate mechanical components of the valves to adjust the degree to which the valves are opened or closed. Additionally, or alternatively, in connection with the steps 102 and 104, the controller 58 may perform similar monitoring and controlling for blending equipment 8 and/or fracturing rigs 10 to implement the continuous pumping. For example, the controller 58 may generate control signals 88 to start a set of equipment for pumping to a second well head 18 while pumping to a first well head 18.

Additionally, or alternatively, in connection with the steps at 102 and 104, the controller 58 may monitor fluid pressure at the well heads 18 during switching of flow from one well head 18 to another well head 18. For example, the controller 58 may monitor information including an open or closed state of various valves of the hydraulic fracturing system 2, and may control the valves to prevent falling below a minimum suction pressure or from going lower than the low pressure limit at any of the well heads 18. As a specific example, the controller 58 may generate control signals 88 to actuate mechanical components of the valves to adjust the degree to which the valves are opened or closed based on increases or decreases in the fluid pressures. As another example, the controller 58 may monitor and control the blending equipment 8 to prevent the hydraulic fracturing system 2 from exceeding the pressure limit while pumping to multiple well heads 18 at the same time. For example, the controller 58 may generate control signals 88 to adjust a mixture of the fracturing fluid, an output flow rate of the blending equipment 8, and/or the like.

Additionally, or alternatively, in connection with the steps 102 and 104, the controller 58 may monitor and control pumps of the fracturing rigs 10. For example, the controller 58 may monitor an output pressure or flow rate of the pumps (e.g., alone or in connection with pressures at the valves of the hydraulic fracturing system 2) and may generate control signals 88 to increase or decrease a flow rates or pressures from the pumps based on detected downstream pressures at the well heads 18. As another example, the controller 58 may monitor and control one or more subsystems within safety limits for fluid pressure during the continuous pumping. For example, the controller 58 may, when the controller 58 detects that an operational parameter has exceeded a safety limit or is within a threshold percentage of the safety limit for the fluid pressure, generate control signals 88 to increase or decrease certain operational parameters related to the safety limit, to cause a hard stop of certain equipment of the hydraulic fracturing system 2, and/or the like.

Although the method 100 illustrated in FIG. 5 is described as including steps 102 and 104, the method 100 may not include all of these steps or may include additional or different steps. For example, the controller 58 may determine which equipment, components of the equipment, etc. are causing an issue during well head 18 switching based on processing operation-related or state-related information 82 using the control logic 84. As a specific example, if the controller 58 determines that the fluid pressure at a well head 18 is exceeding a pressure limit during switching well heads 18 and additionally determines that one or more zipper valves 14 are closed to a greater amount than expected, the controller 58 may determine that the excessively closed zipper valves 14 are the cause of the excess fluid pressure.

The controller 58 may, based on the monitoring the operation or the state of one or more subsystems, control the one or more subsystems within operating limits or based on operating expectations to cause or prevent an occurrence of one or more events. The one or more events may be related to well integrity during hydraulic fracturing operations. For example, the one or more events to be caused may include a well pressure meeting or maintaining a minimum well pressure, the well pressure being within a range of pressure values, an operation speed (e.g., transmission speed) of the one or more subsystems meeting or maintaining a minimum operation speed, the operation speed being within a range of speed values, and/or the like. Additionally, or alternatively, for example, the one or more events to be prevented may include the well pressure exceeding a pressure limit, a well collapse, stalling of the one or more subsystems, a deviation from a fracturing schedule, and/or the like. Additionally, or alternatively, certain embodiments may prevent cavitation on a low pressure line due to blender equipment 8 not providing enough pressure. For example, controller 58 may send an instruction to ramp down the pump experiencing cavitation and ramping up one or more other pumps to compensate for the ramped-down pumps. Additionally, or alternatively, certain embodiments may control operational efficiency to prevent loss of fuel by controlling fuel pressure, prevent loss of blending by controlling gas pressure, and/or the like. Additionally, or alternatively, certain embodiments may prevent operational interruption of an electric fracturing rig 10 by preventing loss of power or voltage, preventing start up of an electric fracturing rig 10 before a power source is ready (e.g., by checking power prior to ramping), and/or the like.

Additionally, or alternatively, the method 100 may include optimizing operation of one or more subsystems of the hydraulic fracturing system 2 using a particle swarm algorithm or another type of optimization algorithm. For example, a particle swarm algorithm may iteratively tune operational parameters to search for a set of optimized operational parameters 80 ($P_1$, $P_2$, . . . $P_n$) that achieve an optimization objective. In this way, "optimized," "optimization" and similar terms used herein may refer to a selection of values (for operational parameters) based on some criteria (an objective) from a set of available values. An objective may be of any suitable type, such as minimizing the cost of fracturing operations of the hydraulic fracturing system 2, minimizing fuel or power consumption of the hydraulic fracturing system 2, minimizing emissions from the hydraulic fracturing system 2, maximizing an operational life of equipment of the hydraulic fracturing system 2, minimizing an overall time of the hydraulic fracturing operations, minimizing a cost of ownership of equipment used in the hydraulic fracturing operation, maximizing a maintenance interval of equipment of the hydraulic fracturing system 2, and/or any combinations thereof. In addition, and as another example, the method 100 may further include outputting optimized operational parameters 80. For example, the controller 58 may output the optimized operational parameters 80 to one or more destinations for display (e.g., for approval and/or modification by an operator), storage (e.g., for historical comparison or analysis, for later usage, etc.), inclusion into control signals (e.g., control signals 88 that cause elements of the hydraulic fracturing system 2 to operate according to the optimized operational parameters 80), and/or the like. With respect to inclusion in control signals 88, the controller 58 may use a processor to generate control signals 88 and may output the control signals 88 to a controller 64 or to equipment of the hydraulic fracturing system 2 using a transceiver (or a transmitter) to cause the equipment to operate in a particular manner. In this way, the controller 58 may conserve equipment life, fuel, emissions, power, etc. of the hydraulic fracturing system 2.

Through optimization of an objective, and generation of corresponding control signals 88 for equipment, certain embodiments may conserve resources (e.g., operational life, power resources, fuel resources, etc.) associated with the hydraulic fracturing system 2 and may facilitate improvements in a site or system-level efficiency of the hydraulic fracturing system 2. Site or system-level optimization may facilitate further gains in efficiency and conservation of resources compared to optimization of individual equipment through consideration of ways in which certain equipment operations affect site-level or system-level objectives. For example, if the objective for the hydraulic fracturing system 2 is to reduce fuel consumption and emissions below a threshold while maintaining a fluid pressure and an operation schedule, the controller 58 may determine that modifying any of the operation of various blending equipment 8 and the operation of various fracturing rigs 10 can reduce the fuel consumption and the emissions to a suitable level, but that just modifying the operation of the blending equipment 8 will keep the hydraulic fracturing operations on schedule. The one or more destinations may include the user device 22 (or a display of the user device 22), a server device, a controller, a database, memory, etc.

In this way, the controller 58 of certain embodiments can provide real-time (or near real-time) monitoring and controlling of fluid pressures at two or more well heads 18 for continuous pumping based on an operation schedule. This may improve operation of a hydraulic fracturing system 2 from a site-level perspective by facilitating automatic control of the switching of well heads 18, which may improve an efficiency of the operations. In addition, certain embodiments described herein may increase safety at a hydraulic fracturing system 2 by providing for faster responses to triggers for switching well heads 18, by reducing or eliminating a need for human operators to be physically present at the well heads 18, and/or the like. Furthermore, certain embodiments may reduce or eliminate latency between stages of hydraulic fracturing operations through operation schedule-based control, which may improve an efficiency of the hydraulic fracturing system 2, conserve fuel or power resources by reducing an amount of time needed to perform hydraulic fracturing operations, and/or the like.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
one or more fracturing rigs;
one or more blending equipment fluidly connected to inlets of the one or more fracturing rigs;
one or more power sources electrically connected to a first subset of the one or more fracturing rigs, or one or more fuel sources fluidly connected to a second subset of the one or more fracturing rigs;
one or more missile valves fluidly connected to outlets of the one or more fracturing rigs;
zipper valves fluidly connected to outlets of the one or more missile valves, the zipper valves including a first zipper valve and a second zipper valve;
one or more well head valves fluidly connected to outlets of the zipper valves;
multiple well heads fluidly connected to outlets of the one or more well head valves; and
a controller, wherein the controller is configured to:
monitor, for two or more well heads of the multiple well heads, an operation or a state of one or more subsystems of the hydraulic fracturing system, and
control, based on an operation schedule for the hydraulic fracturing system, based on one or more of fuel-related information or emissions-related information, and based on monitoring the operation or the state, fluid pressures at the two or more well heads for continuous pumping by opening the second zipper valve before closing the first zipper valve.

2. The hydraulic fracturing system of claim 1,
wherein the two or more well heads include a first well head and a second well head,
wherein the controller is further configured, when controlling the fluid pressures, to:
open the second well head and the second zipper valve;
start pumping at the second well head; and
close the first well head and the first zipper valve after opening the second zipper valve and after starting the pumping at the second well head.

3. The hydraulic fracturing system of claim 1, wherein the one or more subsystems are associated with pumping a fracturing fluid to the two or more well heads, and
wherein the one or more subsystems comprise pumps of at least one of the one or more fracturing rigs, at least one of the one or more missile valves, at least one of the one or more well head valves, or at least one of the zipper valves.

4. The hydraulic fracturing system of claim 1, wherein the controller is further configured, when controlling the fluid pressures, to:
control one or more valve states for at least one of the one or more missile valves, at least one of the zipper valves, or at least one of the one or more well head valves based on the operation schedule, the operation, or the state.

5. The hydraulic fracturing system of claim 1,
wherein the controller is further configured, when monitoring the operation or the state, to:
monitor an open or a closed state of the one or more missile valves, the one or more well head valves, or the zipper valves, and
wherein the controller is further configured, when controlling the fluid pressures, to:
control the one or more missile valves, the one or more well head valves, or the zipper valves to prevent the hydraulic fracturing system from exceeding a pressure limit.

6. The hydraulic fracturing system of claim 1, wherein the controller is further configured to operate in one or more operational modes, and
wherein the one or more operational modes comprise at least one of:
a closed mode,
an autonomous mode, or
a multi-site mode.

7. A method, comprising:

monitoring, for two or more well heads of a hydraulic fracturing system, an operation or a state of one or more subsystems of the hydraulic fracturing system, wherein the hydraulic fracturing system further comprises zipper valves, and wherein the zipper valves include a first zipper valve and a second zipper valve; and controlling fluid pressures at the two or more well heads for continuous pumping by opening the second zipper valve before closing the first zipper valve based on monitoring the operation or the state and based on one or more of:

minimizing fuel or power consumption, minimizing emissions, or maximizing an operational life of equipment of the hydraulic fracturing system.

8. The method of claim 7, wherein controlling the fluid pressures comprises:

starting pumping at a first well head of the two or more well heads;

starting pumping at a second well head of the two or more well heads after starting the pumping at the first well head; and stopping the pumping at the first well head after starting the pumping at the second well head.

9. The method of claim 7, wherein monitoring the operation or the state further comprises:

monitoring an open or a closed state of one or more missile valves of the hydraulic fracturing system, one or more well head valves of the hydraulic fracturing system, or the zipper valves for the two or more well heads; and wherein controlling the fluid pressures further comprises:

controlling the open or the closed state of the one or more missile valves, the one or more well head valves, or the zipper valves for the two or more well heads to prevent the fluid pressures from exceeding a pressure limit for the hydraulic fracturing system during the continuous pumping.

10. The method of claim 7, wherein the fluid pressures are controlled further based on an operation schedule that is for a planned well completion.

11. The method of claim 7, wherein controlling the fluid pressures comprises:

opening or closing at least one of one or more missile valves of the hydraulic fracturing system, at least one of the zipper valves, or at least one of the two or more well heads; and ramping pumping of at least one of one or more blending equipment or pumps, of at least one of one or more fracturing rigs of the hydraulic fracturing system, after the opening or the closing.

12. The method of claim 7, wherein controlling the fluid pressures comprises:

controlling the fluid pressures within a pressure limit for the hydraulic fracturing system.

13. The method of claim 7, wherein the one or more subsystems are associated with pumping a fracturing fluid to the two or more well heads, and wherein the one or more subsystems comprise at least one of one or more blending equipment of the hydraulic fracturing system, at least one of one or more missile valves of the hydraulic fracturing system, at least one of the zipper valves, or at least one of one or more well head valves of the hydraulic fracturing system.

14. The method of claim 7, wherein controlling the fluid pressures comprises:

controlling the fluid pressures by opening the second zipper valve before closing the first zipper valve and by closing the first zipper valve after opening the second zipper valve.

15. A controller for a hydraulic fracturing system, the controller being configured to:

monitor, for two or more well heads of the hydraulic fracturing system, an operation or a state of one or more subsystems of the hydraulic fracturing system, wherein the hydraulic fracturing system further comprises zipper valves, and wherein the zipper valves include a first zipper valve and a second zipper valve; and control fluid pressures at the two or more well heads for continuous pumping by opening the second zipper valve before closing the first zipper valve based on monitoring the operation or the state and based on one or more of:

minimizing fuel or power consumption, minimizing emissions, or maximizing an operational life of equipment of the hydraulic fracturing system.

16. The controller of claim 15, further configured, when controlling the fluid pressures, to:

start pumping at a first well head of the two or more well heads;

start pumping at a second well head of the two or more well heads after starting the pumping at the first well head; and stop the pumping at the first well head after starting the pumping at the second well head.

17. The controller of claim 15, further configured, when monitoring the operation or the state, to:

monitor the operation or the state of pumps of at least one of the one or more subsystems, wherein the controller is further configured, when controlling the fluid pressures, to:

control the pumps to meet an expected fluid pressure during the continuous pumping.

18. The controller of claim 15, further configured, when monitoring the operation or the state, to:

monitor the operation or the state based on information from one or more valve controllers or one or more valve sensors associated with the two or more well heads.

19. The controller of claim 15, further configured, when controlling the fluid pressures, to:

control the fluid pressures within one or more safety limits for the two or more well heads.

20. The controller of claim 15, further configured, when controlling the fluid pressures, to:

control the fluid pressures by opening the second zipper valve before closing the first zipper valve and by closing the first zipper valve after opening the second zipper valve.

* * * * *